US006298629B1

(12) United States Patent
Ador

(10) Patent No.: US 6,298,629 B1
(45) Date of Patent: Oct. 9, 2001

(54) SAFETY LINE ANCHORAGE ASSEMBLIES

(75) Inventor: Bernard R. Ador, Raquefort les Pins (FR)

(73) Assignee: Protecta International S.A. (FR)

( * ) Notice: Subject to any disclaimer, the term of this patent is extended or adjusted under 35 U.S.C. 154(b) by 0 days.

(21) Appl. No.: 09/366,796

(22) Filed: Aug. 4, 1999

(51) Int. Cl.[7] ..... E04B 1/38

(52) U.S. Cl. ..... 52/698; 52/148; 52/152; 52/40; 248/72; 248/220.21; 248/229.24; 248/237; 182/3; 182/8; 182/9; 182/45; 403/100; 403/385

(58) Field of Search ..... 52/DIG. 12, 148, 52/152, 40; 248/72, 220.21, 205.5, 310, 231.61, 228.5, 229.24, 219.4, 63; 182/3, 8, 9; 403/100, 385

(56) References Cited

U.S. PATENT DOCUMENTS

| | | | | |
|---|---|---|---|---|
| 2,886,277 | * | 5/1959 | Boham et al. | 248/206 |
| 2,906,551 | | 9/1959 | May . | |
| 3,825,358 | * | 7/1974 | Eisenhardt et al. | 403/188 |
| 4,032,245 | | 6/1977 | Woodruff . | |
| 5,526,896 | * | 6/1996 | O'Rourke | 182/3 |
| 5,730,407 | * | 3/1998 | Ostrobrod | 248/237 |

FOREIGN PATENT DOCUMENTS

| | | |
|---|---|---|
| 591856 | 7/1925 | (FR) . |
| 2253455 | 7/1975 | (FR) . |
| 751364 | 6/1956 | (GB) . |

* cited by examiner

*Primary Examiner*—Carl D. Friedman
*Assistant Examiner*—Christy M. Syres
(74) *Attorney, Agent, or Firm*—Mau & Krull, P.A.

(57) ABSTRACT

An anchorage kit 100 includes components which may be assembled in various ways to provide anchorages 101–107 suitable for connection in series between a safety line and any of various structural members. The kit 100 includes opposing brackets 120, 140 which are interconnected by bolts 170 extending therebetween, and which may be supplemented by one or more braces 160 secured to the intermediate portion of one or more of the bolts 170.

23 Claims, 6 Drawing Sheets

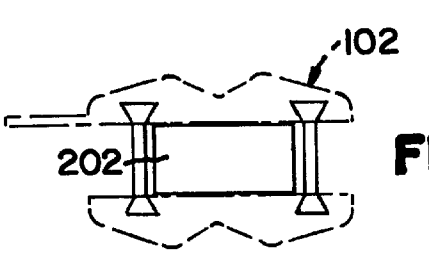
FIG.10
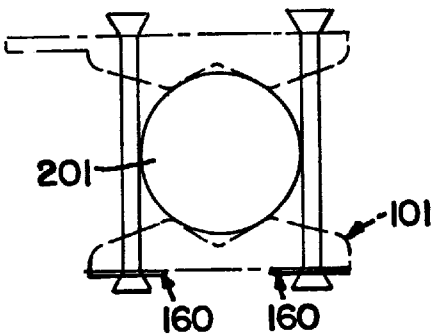
FIG. 9
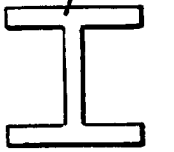
FIG.11F
FIG.11e
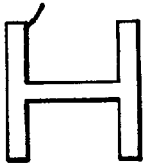
FIG.11d
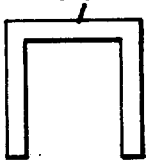
FIG.11c
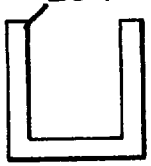
FIG.11b
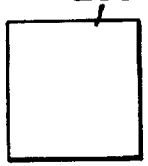
FIG.11a
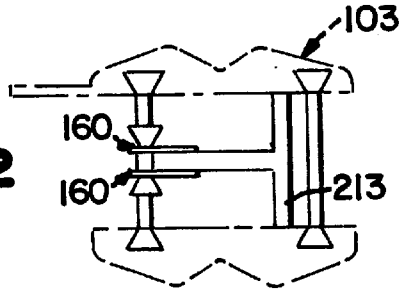
FIG.12

104
160
214
160

105
160
215
160

106
160
216a 160
216b 216c
160

216d
160

107
160
160
217

SAFETY LINE ANCHORAGE ASSEMBLIES

FIELD OF THE INVENTION

The present invention relates to methods and apparatus for providing an anchorage between two members, such as a safety line and a support structure.

BACKGROUND OF THE INVENTION

Various occupations place people in precarious positions at relatively dangerous heights, thereby creating a need for fall-arresting safety apparatus. Such apparatus typically require a reliable safety line and reliable connections to both the support structure and persons working in proximity to the support structure. An object of the present invention is to provide an improved anchorage suitable for supporting a safety line in a variety of installation environments and/or relative to a variety of structural members.

SUMMARY OF THE INVENTION

The present invention provides methods and apparatus for anchoring a first member to a second member. A preferred embodiment of the present invention includes two brackets, two braces, two bolts, and enough threaded nuts to clamp the brackets and braces relative to a structural member. The components are configured to be assembled in a variety of ways to provide anchorages suitable for mounting on a variety of structural members. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

FIG. 9 shows the first anchorage assembly mounted on a support member having a first profile;

FIG. 10 shows a second anchorage assembly constructed with the components of FIG. 1 and mounted on a support member having a second profile;

FIGS. 11*a*–11*f* show additional support member profiles which are compatible with the anchorage assembly of FIG. 10;

FIG. 12 shows a third anchorage assembly constructed with the components of FIG. 1 and mounted on a support member having another profile;

DETAILED DESCRIPTION OF THE PREFERRED EMBODIMENT

Figure 1:
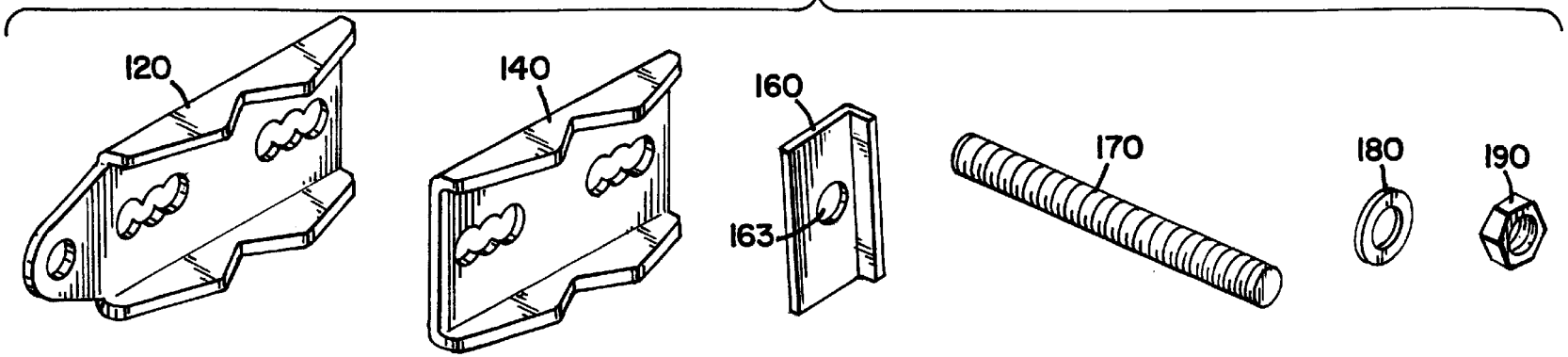
FIG. 1 is a perspective view of each type of component in an anchorage kit made in accordance with the principles of the present invention.

The components of a preferred embodiment anchorage kit made according to the principles of the present invention are collectively designated as 100 in FIG. 1. The preferred embodiment kit 100 includes a first bracket 120, a second bracket 140, two braces 160, two threaded bolts 170, six washers 180, and six threaded nuts 190. The components of the kit 100 may be assembled in different ways to provide different anchorages.

Figure 5:
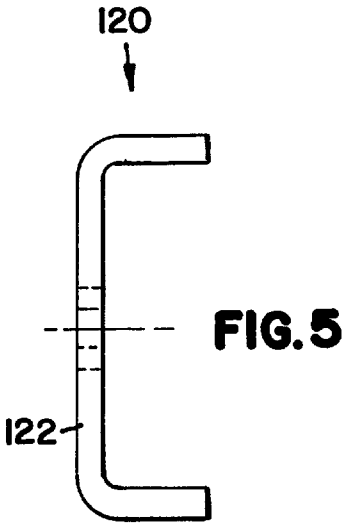
FIG. 5 is an end view of the bracket of FIG. 3.
Figure 3:
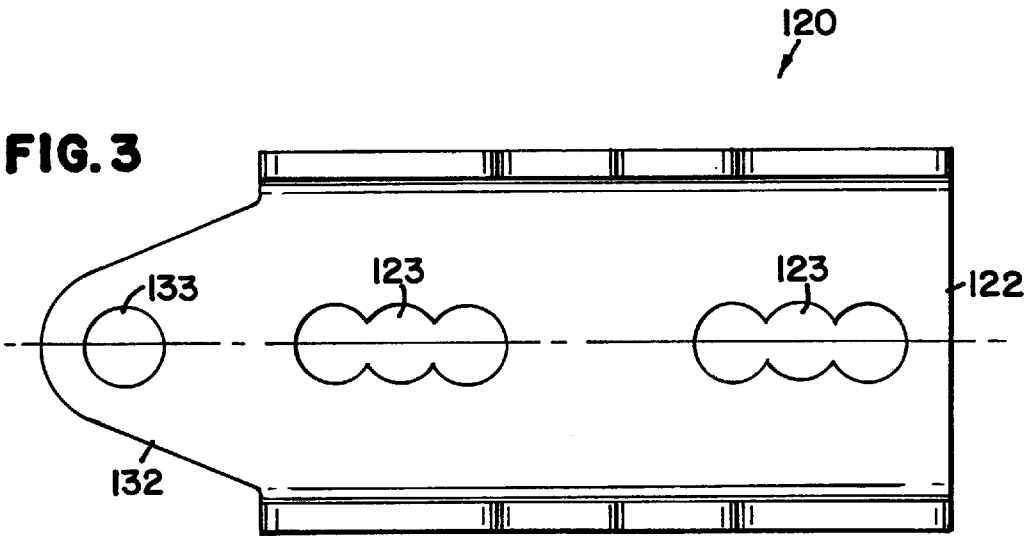
FIG. 3 is a bottom view of a first bracket included in the anchorage kit of FIG. 1.
Figure 4:
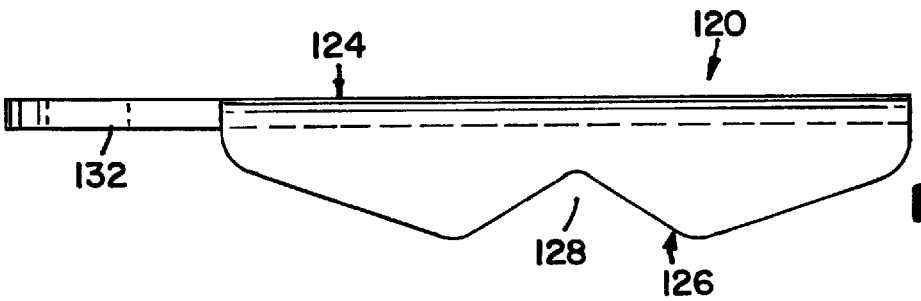
FIG. 4 is a side view of the bracket of FIG. 3.

The first bracket 120 is shown alone in FIGS. 3–5. The first bracket 120 is preferably a steel plate 122 having a U-shaped profile. Openings 123 extend through the base portion of the U-shaped plate 122 to receive respective bolts 170. Each of the openings 123 is sized and configured to support a bolt 170 at three discrete locations relative to the plate 122. An outer side 124 of the base wall provides a flat surface suitable for bearing against a flat surface on a structural member. Each of the side walls of the plate 122 terminates in an edge 126 which faces away from the outer side 124 of the base wall. Each of the side walls is provided with a V-shaped notch 128 which is bounded by converging portions of a respective edge 126, and which defines an angle of approximately one hundred and twenty degrees. The contoured edges 126 are sized and configured to bear against a cylinder or other convex surface on a structural member. The first bracket 120 also includes a tab 132 which is integrally joined to an end of the base wall and extends parallel thereto. A hole 133 extends through the tab 132 to facilitate connection of a safety line to the first bracket 120.

Figure 8:
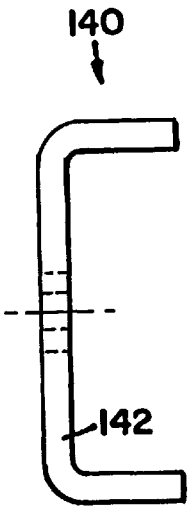
FIG. 8 is an end view of the bracket of FIG. 6.
Figure 6:
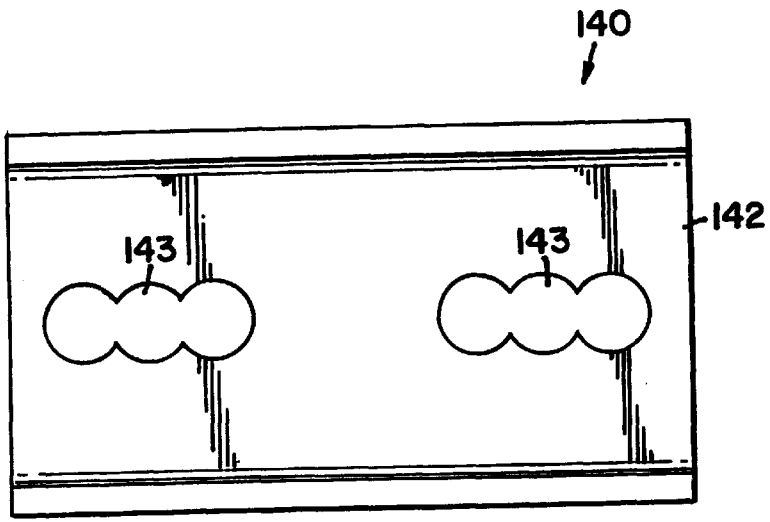
FIG. 6 is a bottom view of a second bracket included in the anchorage kit of FIG. 1.
Figure 7:
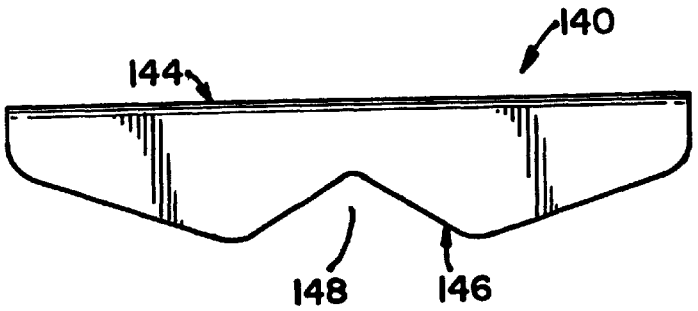
FIG. 7 is a side view of the bracket of FIG. 6.

The second bracket 140 is shown alone in FIGS. 6–8. Except for the absence of tab 132, the second bracket 140 is identical to the first bracket 120. In other words, the second bracket 140 is also preferably a steel plate 142 having a U-shaped profile. Openings 143 extend through the base portion of the U-shaped plate 142 to receive respective bolts 170. Each of the openings 143 is sized and configured to support a bolt 170 at three discrete locations relative to the plate 142. An outer side 144 of the base wall provides a flat surface suitable for bearing against a flat surface on a structural member. Each of the side walls of the plate 142 terminates in an edge 146 which faces away from the outer side 144 of the base wall. Each of the side walls is provided with a V-shaped notch 148 which is bounded by converging portions of a respective edge 146, and which defines an angle of approximately one hundred and twenty degrees. The contoured edges 146 are sized and configured to bear against a cylinder or other convex surface on a structural member.

Each of the braces 160 is preferably a steel plate having an L-shaped profile. A hole 163 extends through the relatively longer segment of each brace 160 to receive a respective bolt 170. An outer side of each longer segment provides a flat surface suitable for bearing against a flat surface on a structural member. The relatively shorter segment of each brace 160 terminates in an edge 166 which faces away from the outer side on a respective longer segment. Depending on the application, the edge 166 may bear against an opposing edge 166 on another brace 160, or against one of the plates 120 or 140, or against a portion of a structural member. Also, depending on the application, the longer segment and the shorter segment may cooperate to cover a corner on a structural member.

Each of the bolts 170 is provided with an external helical thread. Each of the washers 180 is sized and configured to fit onto either of the bolts 170. Each of the nuts 190 is provided with an internal helical thread and is adapted to thread onto either of the bolts 170. Those skilled in the art will recognize that two bolts with heads could be substituted for the two bolts 170 and two of the nuts 190.

Figure 2:
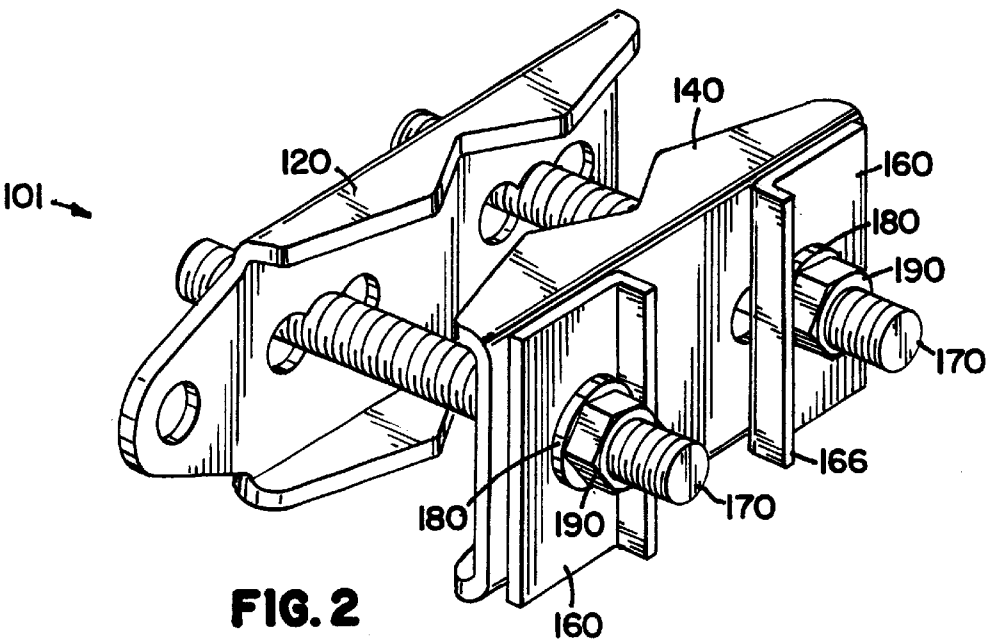
FIG. 2 is a perspective view of a first anchorage assembly constructed with the components of FIG. 1.

FIG. 2 shows the components of the kit 100 (except for two of the washers 180 and two of the nuts 190) assembled into a first anchorage 101. FIG. 9 shows this particular anchorage 101 mounted on a structural member 201 having a circular cross-section. The brackets 120 and 140 are arranged so that their respective edges 126 and 146 face toward one another and engage diametrically opposed portions of the structural member 201. The braces 160 are arranged relative to the second bracket 140 so that the longer segments bear against the outer side 144, and the shorter segments are relatively close to one another. The bolts 170 are inserted through aligned holes in the brackets 120 and 140 and the braces 160. After a washer 180 is placed onto each end of each bolt 170, a nut 190 is threaded onto each end of each bolt 170 to mount the anchorage 101 on the structural member 201.

FIG. 10 shows the same components of the kit 100 assembled into a second anchorage 102 which is mounted on a structural member 202 having a rectangular cross-section. The brackets 120 and 140 are arranged so that their respective outer sides 124 and 144 face toward one another and engage opposite sides of the structural member 202. The braces 160 may be arranged in a variety of ways, depending on the installation parameters. For example, when the width of the structural member 202 is comparable to the distance between the two openings 123 (and the distance between the two openings 143), then the braces 160 may be arranged like on the previous anchorage 101, but bearing against an opposite, inner side of the base wall on the bracket 140. When the structural member 202 has a relatively smaller width, the braces 160 may be placed onto a single bolt 170, arranged so the longer segments bear against respective outer sides 124 and 144, and further arranged so the shorter segments bear against a common edge of the structural member 202. When the structural member 202 has an even smaller width, the braces 160 may be placed on discrete bolts, arranged so the longer segments bear against respective outer sides 124 and 144, and further arranged so the shorter segments bear against opposite edges of the structural member 202. In any event, the bolts 170, washers 180, nuts 190 are secured in place like on the previous anchorage 101.

FIGS. 11*a*–11*f* show additional structural members 203–208 having discrete cross-sections. The components of the kit 100 may be arranged as described in the preceding paragraph to provide an anchorage suitable for mounting on any of these members 203–208. Again, the arrangement of the braces 160 will vary according to the size and shape of the structural member.

FIG. 12 shows all of the components of the kit 100 assembled into a third anchorage 103 which is mounted on a structural member 213 having a "sideways T" cross-section. The brackets 120 and 140 are arranged so that their respective outer sides 124 and 144 face toward one another and engage opposite distal ends of the structural member 213. One of the bolts 170 is secured between the brackets 120 and 140, proximate the opposite distal ends of the structural member 213, by means of washers 180 and nuts 190. The braces 160 are arranged so the relatively longer segments are disposed on opposite sides of the stem portion of the structural member 213, and the relatively shorter segments extend toward one another. The other bolt 170 is inserted through the brackets 120 and 140 and through the braces 160 in such a manner that the two braces 160 are clamped between opposing washers 180 and nuts 190 on an intermediate portion of the second bolt 170. Additional washers 180 and nuts 190 are secured to opposite ends of the second bolt 170.

Figures 13, 14, 15A, 15B, 15C, 15D, 16:
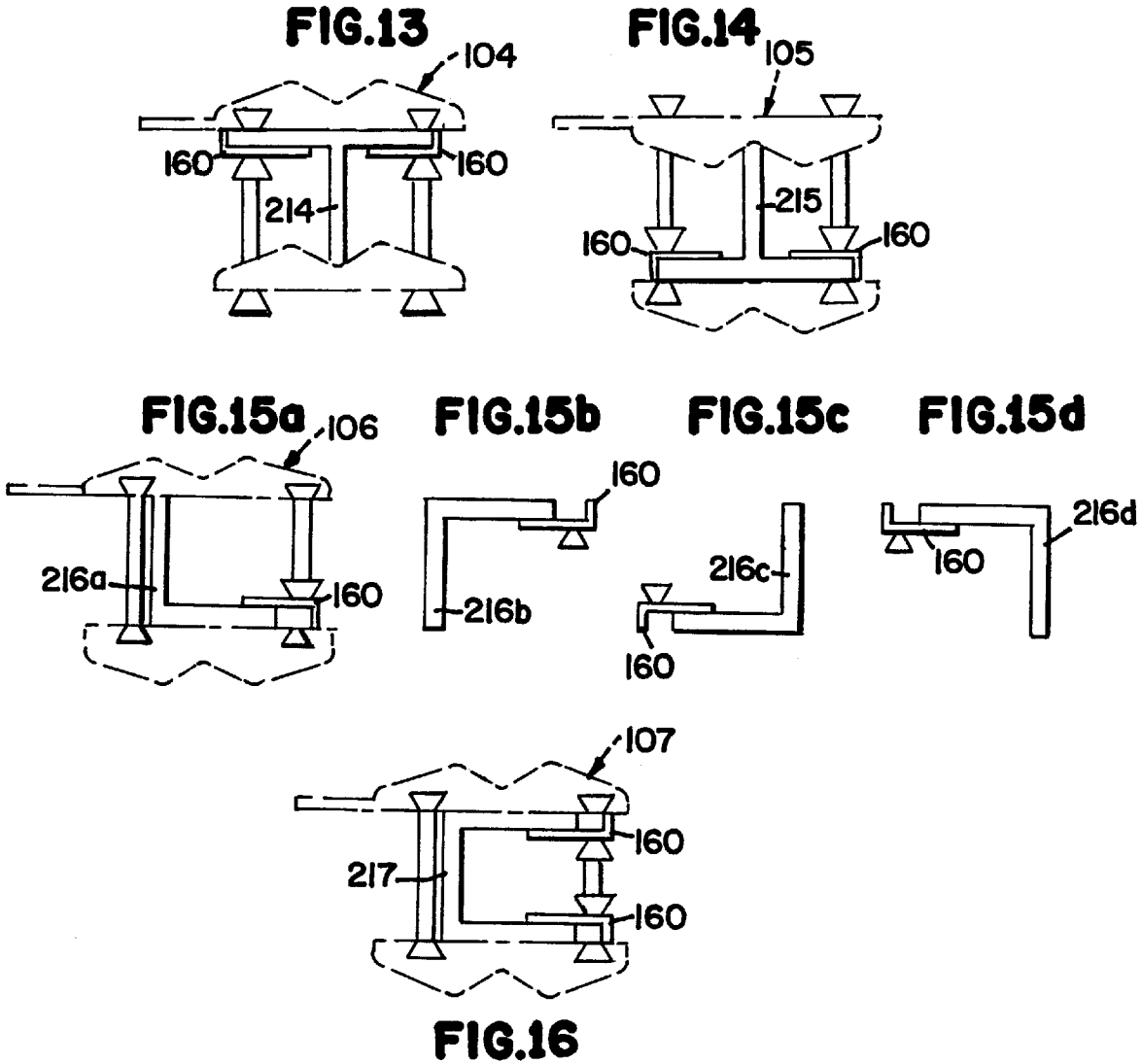
FIG. 13 shows a fourth anchorage assembly constructed with the components of FIG. 1 and mounted on a support member having yet another profile.
FIG. 14 shows a fifth anchorage assembly constructed with the components of FIG. 1 and mounted on a support member have yet another profile.
FIGS. 15*a* shows a sixth anchorage assembly constructed with the components of FIG. 1 and mounted on a support member having yet another profile.
FIG. 15*b*–15*d* show additional support member profiles which are compatible with anchorage assemblies similar to that shown in FIG. 15*a;*
FIG. 16 shows a seventh anchorage assembly constructed with the components of FIG. 1 and mounted on a support member having still another profile.

FIG. 13 shows all of the components of the kit 100 assembled into a fourth anchorage 104 which is mounted on a structural member 214 having an upright T-shaped cross-section. The bracket 120 is arranged so that its outer side 124 bears against the top surface of the structural member 214, and the bracket 140 is arranged so that it bears against the lower distal end of the structural member 214, with its outer side 144 facing away from the first bracket 120. The braces 160 are disposed at opposite sides of the structural member 214, with the relatively longer segments bearing against respective upper portions of the structural member 214, and the shorter segments extending toward respective portions of the first bracket 120 (beyond the edges of the structural member 214). The bolts 170 are inserted through the brackets 120 and 140 and through respective braces 160 in such a manner that a washer 180 and a nut 190 are secured in place immediately beneath each brace 160.

FIG. 14 shows all of the components of the kit 100 assembled into a fifth anchorage 105 which is mounted on a structural member 215 having an inverted T-shaped cross-section. The bracket 120 is arranged so that it bears against the upwardly extending end of the structural member 215, with its outer side 124 facing away from the structural member 215. The bracket 140 is arranged so that its outer side 144 bears against the downwardly facing surface on the structural member 214. The braces 160 are disposed in proximity to the second bracket 140, with the longer segments bearing against the structural member 215, and the shorter segments extending toward respective portions of the second bracket 140. The bolts 170 are inserted through the brackets 120 and 140 and through respective braces 160 in such a manner that a washer 180 and a nut 190 are secured in place immediately above each brace 160.

FIG. 15*a* shows many of the components of the kit 100 assembled into a sixth anchorage 106 which is mounted on a structural member 216*a* having an L-shaped cross-section. The bracket 120 is arranged so that its outer side 124 bears against an upwardly extending, distal end of the structural member 216*a*. The bracket 140 is arranged so that its outer side 144 bears against a downwardly facing surface on the structural member 216*a*. One of the bolts 170 is secured between aligned holes in the brackets 120 and 140, proximate the vertical flange on the structural member 216*a*, by means of washers 180 and nuts 190. One of the braces 160 is disposed proximate a distal end of the structural member 216*a*, immediately opposite the second bracket 140, with the longer segment bearing against the structural member 216*a*, and the shorter segment extending toward the second bracket 140. The other bolt 170 is inserted through the brackets 120 and 140 and the brace 160 in such a manner that a washer 180 and a nut 190 are secured in place immediately above the brace 160. FIGS. 15*b*–15*d* show how the brace 160 on the anchorage 106 may be rearranged to provide anchorages suitable for mounting relative to three other L-shaped structural members 216*b*–216*d*.

FIG. 16 shows all of the components of the kit 100 assembled into a seventh anchorage 107 which is mounted on a structural member 217 having a "sideways U" cross-section. The brackets 120 and 140 are arranged so that their respective outer sides 124 and 144 face toward one another and bear against opposite sides of the structural member 217. One of the bolts 170 is secured between the brackets 120 and 140, proximate the base of the structural member 217, by means of washers 180 and nuts 190. The braces 160 are disposed at the distal ends of the structural member 217, with the relatively longer segments disposed immediately opposite respective brackets 120 and 140, and with the relatively shorter segments extending across the distal ends and toward respective brackets 120 and 140. The other bolt 170 is inserted through the brackets 120 and 140 and through the braces 160 in such a manner that the two braces 160 are separated by a pair washers 180 and a pair of nuts 190 secured to intermediate portions of the bolt 170.

Figure 17:
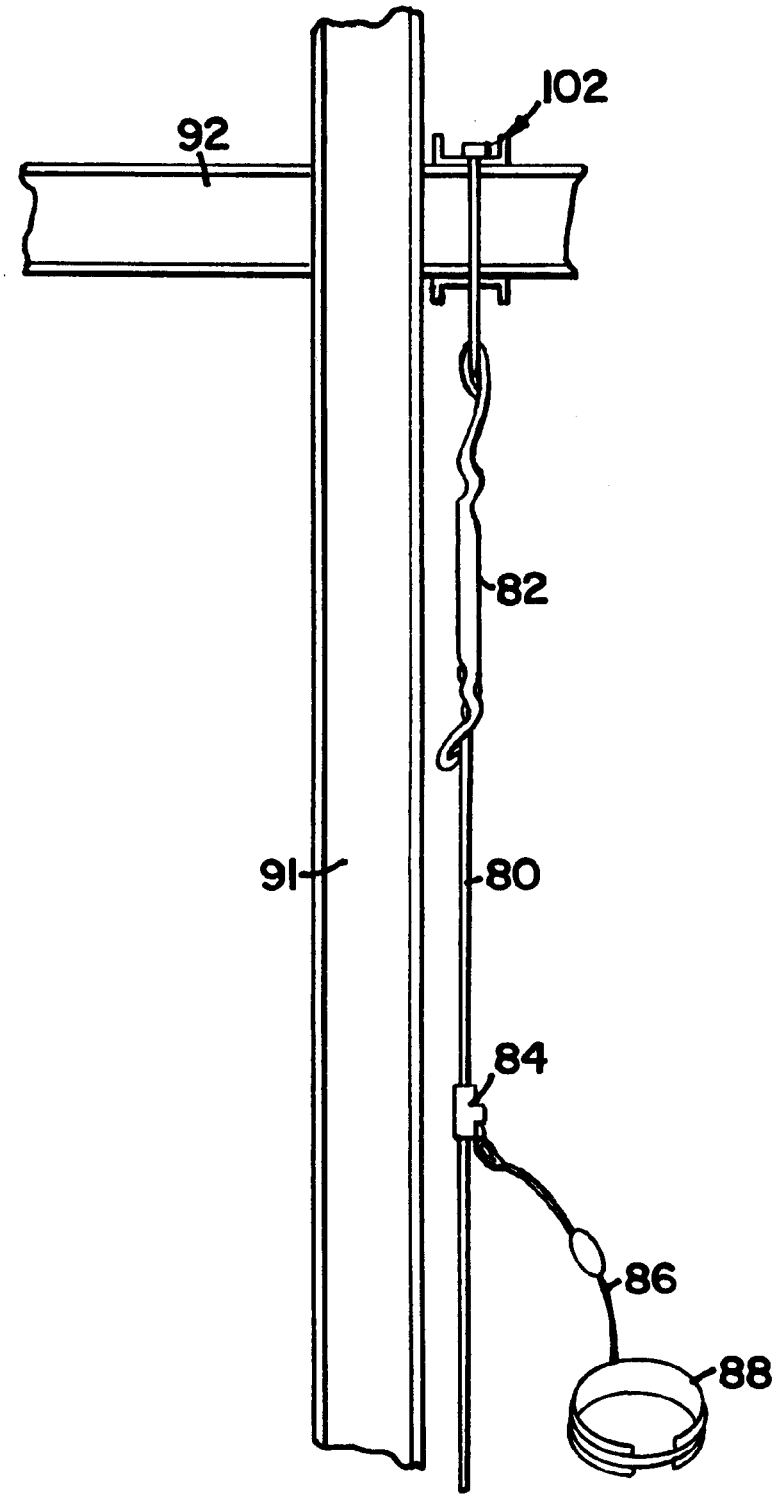
FIG. 17 is a front view of an anchorage similar to that shown in FIG. 10 interconnected between a safety line and a structural member similar to that shown in FIG. 11*e*.

FIG. 17 shows one possible application for an anchorage assembled in accordance with the principles of the present invention. In this application, the anchorage 102 is mounted on a horizontal I-beam 92 which is supported by a vertical I-beam 91. A safety line 80 is connected to the anchorage 102, and an energy absorber 82 is connected in series with the safety line 80. A rope grab 84 is movably mounted on the safety line 80, and a lanyard 86 is connected between the rope grab 84 and a person's safety belt 88.

The present invention may be described as an anchorage kit 100 having components which may be combined in various manners to secure a safety line 80 to various types of support structures, including a first support structure 201 having a circular cross section and a second support structure 202 having a rectangular cross section, comprising: a first bracket 120 and a second bracket 140, wherein said first bracket 120 and said second bracket 140 may be aligned so that a first opening 123 in said first bracket 120 aligns with a first opening 143 in said second bracket 140, and a second opening 123 in said first bracket 120 aligns with a second opening 143 in said second bracket 140, and wherein a third opening 133 is formed in at least one of said first bracket 120 and said second bracket 140 to anchor the safety line 80; a first brace 160 and a second brace 160, wherein at least one opening 163 extends through each said brace 160; a first bolt 170 and a second bolt 170, wherein said first bolt 170 is sized and configured to insert through each said first opening 123, 143 and through said at least one opening 163 in said first brace 160, and said second bolt 170 is sized and configured to insert through each said second opening 123, 143 and through said at least one opening 163 in said second brace 160; and at least four threaded nuts 190 sized and configured to thread onto said bolts 170, wherein each said bolt 170 may be secured at each end relative to a respective bracket 120, 140, and each said brace 160 may be secured at an intermediate point along a respective bolt 170. The anchorage kit 100 further comprises a washer 180 for each said threaded nut 190. Each said bolt 170 has opposite threaded ends, and said at least four threaded nuts 190 includes six said nuts 190. At least one said bracket 120 or 140 has a first side 124 or 144 configured to bear against a flat surface, and a second, opposite side 126 or 146 configured to engage at least four points on a cylindrical surface, and only as many as two of said points is intersected by any given line. Said first bracket 120 has a flat side 124 configured to bear against a flat surface, and said second bracket 140 has a contoured side 146 configured to engage at least four points on a cylindrical surface, and only as many as two of said points is intersected by any given line.

The present invention may also be described as an anchorage assembly 102 interconnected in series between a safety line 80 and a structural member 92, comprising: a first bracket 120 having a first bearing surface 124 which is flat and a second bearing surface 126 which is concave, wherein said first bearing surface 124 and said second bearing surface 126 face in opposite directions; a second bracket 140 having at least one of a bearing surface 144 which is flat and a bearing surface 146 which is concave, wherein an opening 133 extends through at least one of said first bracket 120 and said second bracket 140 to anchor the safety line 80; and at least two bolts 170 interconnected between said first bracket 120 and said second bracket 140, wherein said bolts 170 extend perpendicular to said first bearing surface 124 on said first bracket 120. Said second bracket 140 has a flat bearing surface 144 and a concave bearing surface 146, and said flat bearing surface 144 and said concave bearing surface 146 face in opposite directions. Each said bracket 120, 140 has a U-shaped cross-section.

The anchorage assembly of the foregoing paragraph may be described as further comprising an L-shaped brace 160 defining a hole 163 sized and configured to receive one of said bolts 170, wherein said brace 160 has a relatively longer segment which extends parallel to said first bearing surface 124 on said first bracket 120, and a relatively shorter segment which extends perpendicular to said relatively longer segment, and a flange on the structural member is clamped between said relatively longer segment and one of said first bracket 120 and said second bracket 140. In the alternative, the anchorage assembly of the foregoing paragraph may be described as further comprising two L-shaped braces 160, each of said braces 160 defining a hole 163 sized and configured to receive one of said bolts 170, and each of said braces 160 having a relatively longer segment which extends parallel to said first bearing surface 124 on said first bracket 120, and a relatively shorter segment which extends perpendicularly away from said first bearing surface 124 on said first bracket 120.

The present invention may also be described as an anchorage assembly 102 interconnected in series between a safety line 80 and a structural member 92 having at least one flange which terminates in a distal end, comprising: a first bracket 120 having at least one bearing surface 124 or 126; a second bracket 140 having at least one bearing surface 144 or 146, wherein at least one of said first bracket 120 and said second bracket 140 is configured to anchor the safety line 80; a brace 160 sized and configured to bear against the at least one flange proximate the distal end, wherein said brace 160 is disposed between said first bracket 120 and said second bracket 140; and at least two bolts 170 interconnected between said first bracket 120 and said second bracket 140, wherein said bolts 170 extend perpendicular to said at least one bearing surface 124 or 126, 144 or 146 on each said bracket 120, 140, and at least one of said bolts 170 extends through a hole 163 in said brace 160, and said brace 160 is clamped to said flange by at least one nut 190 threaded onto said at least one of said bolts 170. Said first bracket 120 has a first bearing surface 124 which is flat, and said first bracket has a second bearing surface 126 which is contoured, and said first bearing surface 124 and said second bearing surface 126 face in opposite directions. Said second bracket 140 has a first bearing surface 144 which is flat, and said second bracket 140 has a second bearing surface 146 which is contoured, and said first bearing surface 144 and said second bearing surface 146 on said second bracket 140 face in opposite directions. Each said bracket 120, 140 has a U-shaped cross-section. The anchorage assembly further comprises a second brace 160 sized and configured to bear against the structural member proximate another distal flange end, wherein said second brace 160 is disposed between said first bracket 120 and said second bracket 120, and said second brace 160 is clamped to said structural member by at least one nut 190 threaded onto at least one of said bolts 170.

Although the present invention has been described with reference to a preferred embodiment and a particular application, this disclosure will enable those skilled in the art to recognize additional embodiments and/or applications which fall within the scope of the present invention. For example, the present invention may be used in other systems and/or environments to support lines which may not extend vertically, for example. Thus, the scope of the present invention should be limited only to the extent of the following claims.

What is claimed is:

1. An anchorage kit having components which may be combined in various manners to secure a safety line to various types of support structures, comprising:

a first bracket and a second bracket, wherein said first bracket and said second bracket may be aligned so that a first opening in said first bracket aligns with a first opening in said second bracket, and a second opening in said first bracket aligns with a second opening in said second bracket, and wherein a third opening is formed in at least one of said first bracket and said second bracket to anchor the safety line;

a first brace and a second brace, wherein at least one opening extends through each said brace;

a first bolt and a second bolt, wherein said first bolt is sized and configured to insert through each said first opening and through said at least one opening in said first brace, and said second bolt is sized and configured to insert through each said second opening and through said at least one opening in said second brace; and at least four threaded nuts sized and configured to thread onto said bolts, wherein each said bolt may be secured at each end relative to a respective bracket, and each said brace may be secured at an intermediate point along a respective bolt.

2. The anchorage kit of claim 1, further comprising a washer for each said threaded nut.

3. The anchorage kit of claim 1, wherein each said bolt has opposite threaded ends, and said at least four threaded nuts includes six said nuts.

4. The anchorage kit of claim 1, wherein at least one said bracket has a first side configured to bear against a flat surface, and a second, opposite side configured to engage at least four points on a cylindrical surface, and only as many as two of said points is intersected by any given line.

5. The anchorage kit of claim 4, wherein said first bracket has a flat side configured to bear against a flat surface, and said second bracket has a contoured side configured to engage at least four points on a cylindrical surface, and only as many as two of said points is intersected by any given line.

6. The anchorage kit of claim 1, wherein said first bracket has a flat side configured to bear against a flat surface, and said second bracket has a contoured side configured to engage at least four points on a cylindrical surface, and only as many as two of said points is intersected by any given line.

7. An anchorage assembly interconnected in series between a safety line and a structural member, comprising:

a first bracket having a first bearing surface which is flat and faces in a first direction, and a second bearing surface which is concave and faces in a second, opposite direction;

a second bracket having at least one of a bearing surface which is flat and a bearing surface which is concave, wherein an opening extends through at least one of said first bracket and said second bracket to anchor the safety line;

at least two bolts interconnected between said first bracket and said second bracket, wherein said bolts extend perpendicular to said first bearing surface on said first bracket; and an L-shaped brace defining a hole sized to receive one of said bolts, wherein said brace has a relatively longer segment which extends parallel to said first bearing surface on said first bracket, and a relatively shorter segment which extends perpendicular to said relatively longer segment, and a flange on the structural member is clamped between said relatively longer segment and one of said first bracket and said second bracket.

8. The anchorage assembly of claim 7, wherein said second bracket has a flat bearing surface and a concave bearing surface, and said flat bearing surface and said concave bearing surface face in opposite directions.

9. The anchorage assembly of claim 8, wherein each said bracket has a U-shaped cross-section.

10. The anchorage assembly of claim 7, wherein each said bracket has a U-shaped cross-section.

11. The anchorage assembly of claim 7, further comprising an L-shaped brace defining a hole sized to receive one of said bolts, wherein said brace has a relatively longer segment which extends parallel to said first bearing surface on said first bracket, and a relatively shorter segment which extends perpendicular to said relatively longer segment, and a flange on the structural member is clamped between said relatively longer segment and one of said first bracket and said second bracket.

12. An anchorage assembly interconnected in series between a safety line and a structural member having at least one flange which terminates in a distal end, comprising:

a first bracket having at least one bearing surface;

a second bracket having at least one bearing surface, wherein at least one of said first bracket and said second bracket is configured to anchor the safety line;

a brace sized and configured to bear against the at least one flange proximate the distal end, wherein said brace is disposed between said first bracket and said second bracket; and at least two bolts interconnected between said first bracket and said second bracket, wherein said bolts extend perpendicular to said at least one bearing surface on each said bracket, and at least one of said bolts extends through a hole in said brace, and said brace is clamped to said flange by at least one nut threaded onto said at least one of said bolts.

13. The anchorage assembly of claim 12, wherein said first bracket has a first bearing surface which is flat, and said first bracket has a second bearing surface which is contoured, and said first bearing surface and said second bearing surface face in opposite directions.

14. The anchorage assembly of claim 13, wherein said second bracket has a first bearing surface which is flat, and said second bracket has a second bearing surface which is contoured, and said first bearing surface and said second bearing surface on said second bracket face in opposite directions.

15. The anchorage assembly of claim 14, wherein each said bracket has a U-shaped cross-section.

16. The anchorage assembly of claim 15, further comprising a second brace sized and configured to bear against the structural member proximate another distal flange end, wherein said second brace is disposed between said first bracket and said second bracket, and said second brace is clamped to said structural member by at least one nut threaded onto at least one of said bolts.

17. The anchorage assembly of claim 12, wherein each said bracket has a U-shaped cross-section.

18. The anchorage assembly of claim 12, further comprising a second brace sized and configured to bear against the structural member proximate another distal flange end, wherein said second brace is disposed between said first bracket and said second bracket, and said second brace is clamped to said structural member by at least one nut threaded onto at least one of said bolts.

19. The anchorage kit of claim 1 secured in a first configuration, wherein said first bracket and said second bracket define opposing concave bearing surfaces suitable for clamping a circular cross section therebetween.

20. The anchorage kit of claim 19 alternatively secured in a second configuration, wherein said first bracket and said second bracket define opposing flat bearing surfaces suitable for clamping a rectangular cross section therebetween.

21. An anchorage assembly interconnected in series between a safety line and a structural member, comprising:

a first bracket having a first bearing surface which is flat and faces in a first direction, and a second bearing surface which is concave and faces in a second, opposite direction;

a second bracket having at least one of a bearing surface which is flat and a bearing surface which is concave, wherein an opening extends through at least one of said first bracket and said second bracket to anchor the safety line;

at least two bolts interconnected between said first bracket and said second bracket, wherein said bolts extend perpendicular to said first bearing surface on said first bracket; and two L-shaped braces, each of said braces defining a hole sized to receive one of said bolts, and each of said braces having a relatively longer segment which extends parallel to said first bearing surface on said first bracket, and a relatively shorter segment which extends perpendicularly away from said first bearing surface on said first bracket.

22. An anchorage assembly interconnected in series between a safety line and a structural member, comprising:

a first bracket having a U-shaped cross section defined by a base plate and opposite side plates, wherein said base plate defines a flat bearing surface that faces away from said side plates, and said side plates have distal edges which face away from said base plate and define a concave bearing surface;

a second bracket having at least one of a bearing surface which is flat and a bearing surface which is concave, wherein an opening extends through at least one of said first bracket and said second bracket to anchor the safety line; and at least two bolts interconnected between said first bracket and said second bracket, wherein said bolts extend perpendicular to said base plate.

23. The anchorage assembly of claim 22, wherein said first bracket has a U-shaped cross section defined by a base plate and opposite side plates, and on said first bracket, said base plate defines a flat bearing surface that faces away from said side plates, and said side plates have distal edges which face away from said base plate and define a concave bearing surface.

* * * * *